US005438268A

United States Patent [19]

Schleupen et al.

[11] Patent Number: 5,438,268

[45] Date of Patent: Aug. 1, 1995

[54] IGNITION SYSTEM FOR DETECTING ARC VOLTAGE OF SPARK PLUG

[75] Inventors: Richard Schleupen, Grossingersheim; Ulrich Bentel, Wiernsheim-Iptingen; Klaus Heyke, Reutlingen-Ohmenhau; Ulrich Nelle, Sonnenbuehl, all of Germany

[73] Assignee: Robert Bosch GmbH, Stuttgart, Germany

[21] Appl. No.: 50,487

[22] PCT Filed: Nov. 16, 1991

[86] PCT No.: PCT/DE91/00902

§ 371 Date: May 7, 1993

§ 102(e) Date: May 7, 1993

[87] PCT Pub. No.: WO92/10673

PCT Pub. Date: Jun. 25, 1992

[30] Foreign Application Priority Data

Dec. 10, 1990 [DE] Germany ..... 40 39 356.9

[51] Int. Cl.[6] ..... F02P 17/12

[52] U.S. Cl. ..... 324/399

[58] Field of Search ..... 324/390, 391, 393, 399; 123/644, 690, 426

[56] References Cited

U.S. PATENT DOCUMENTS 4,918,389 4/1990 Schleupen et al. ..... 324/399
5,156,127 10/1992 Ghaem ..... 324/399 X
5,226,394 7/1993 Shimasaki et al. ..... 324/399 X
5,237,279 8/1993 Shimasaki et al. ..... 324/399 X

FOREIGN PATENT DOCUMENTS 0344349 12/1989 European Pat. Off. .
0408916 1/1991 European Pat. Off. .
2759155 7/1979 Germany .
8909333 10/1989 WIPO .

*Primary Examiner*—Sandra L. O'Shea
*Assistant Examiner*—Warren S. Edmonds
*Attorney, Agent, or Firm*—Michael J. Striker

[57] ABSTRACT

A circuit arrangement for ignition systems for detecting an arc voltage at a spark plug has an ignition coil having a primary side on which the arc voltage is transformed and also having a primary winding, an ignition switch located in series with the primary winding of the ignition coil, a pnp transistor working as a voltage converter and having a control stage so that the arc voltage transformed on the primary side activates the control stage. The transistor is connected on an emitter side to a connection between the primary winding and the ignition switch. The pnp transistor is connected on a base side to a battery voltage. A resistor is assigned as an emitter follower to the pnp transistor. A measuring element is formed as a resistor. The transistor with its collector connection feeds to the measuring element a collector current which is proportional to the arc voltage.

4 Claims, 1 Drawing Sheet

IGNITION SYSTEM FOR DETECTING ARC VOLTAGE OF SPARK PLUG

BACKGROUND OF THE INVENTION

The present invention relates to an ignition system for internal combustion engines.

More particularly, it relates to a circuit arrangement for ignition systems for detecting an arc voltage at a spark plug, which voltage is transformed onto a primary side of an ignition coil.

An ignition system is already known from U.S. Pat. No. 4,918,389 or from the corresponding EP-A-0,344,349, and in this the monitoring of the ignition system is carried out by means of a primary-side monitoring of the spark duration. The disadvantage of this method, however, is that it does not give exact information on the combustion trend, in order thereby to draw conclusions as to the functioning of the ignition system and/or injection system. Malfunctions therefore cannot be detected reliably, and because of this an increased exchange of harmful substances can occur and the catalyst be put at risk.

To satisfy the exhaust-gas value requirements of the environmental authorities, the aim is to develop ignition controls which guarantee the least possible ejection of harmful substances in four-stroke petrol engines.

One possibility of ignition and explosion detection is afforded by means of a pressure sensor or optical sensor. However, such function monitoring by the sensors additionally incorporated in the ignition system entails high cost.

SUMMARY OF THE INVENTION

Accordingly, it is an object of the present invention to provide an ignition system for internal combustion engines, which avoids the disadvantages of the prior art.

In keeping with these objects and with others which will become apparent hereinafter, one feature of the present invention resides, briefly stated, in a circuit arrangement for ignition systems of the above-mentioned type, in which the pnp type transistor is connected on the base side to the battery voltage, in that a resistor is assigned as an emitter follower to the pnp-type transistor and in that the latter, with its collector connection, feeds to a measuring element which is designed as a resistor, a collector current which is proportional to the arc voltage.

When the circuit arrangement is designed in accordance with the present invention, the advantage of such an arrangement is that there is generated a current which is proportional to the arc voltage and is monitored via a measuring member and by means of which exact information on the combustion trend is obtained.

In accordance with a further feature of the invention, it is especially advantageous if the resistors used have the same temperature coefficient in order to prevent temperature influences.

A further advantage is the decoupling of the voltage signal and the feed of the control signal for the ignition transistor by way of a signal line. The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
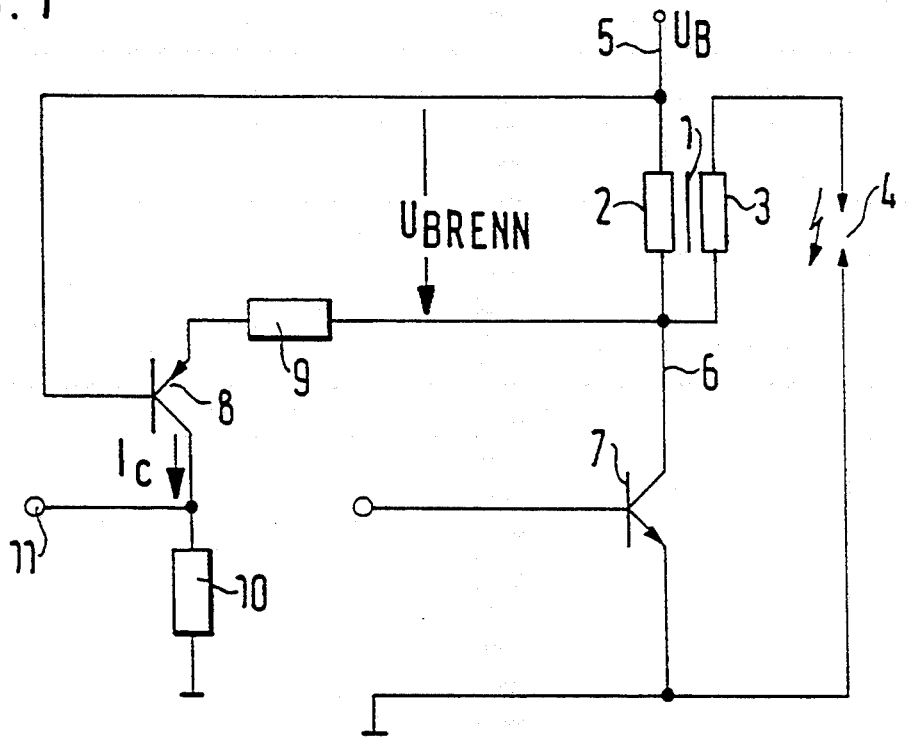
FIG. 1 shows the basic circuit for detecting the arc voltage and FIG. 2 the basic circuit in modified form.

The basic circuit, illustrated in FIG. 1, for detecting the arc voltage shows an ignition coil 1 consisting of a primary winding 2 and of a secondary winding 3 which is connected to a spark plug 4 for the transmission of the high voltage. The primary winding 2 is connected, on the one hand, to a battery voltage $U_B$ by way of a feed line 5 and, on the other hand, to earth potential by way of a feed line 6 and by way of an ignition transistor 7. The feed line 5 is connected to the base of a pnp transistor 8, whilst the latter is connected on the emitter side to the feed line 6 by way of a resistor 9 serving as an emitter follower. On the collector side, the pnp transistor 8 is assigned a resistor 10 which is connected, on the other hand, to earth potential. The voltage dropping across this resistor is detected between the terminal 11 and earth potential.

The circuit arrangement just described in FIG. 1 has the following mode of operation.

The current flux in the primary winding 2 of the ignition coil 1 is cut in by way of the ignition transistor 7, that is to say energy can be stored in the primary winding 2 when the ignition transistor is activated at the base. If the activation of this control transistor 7 is then interrupted, a high voltage is induced in the secondary winding 3 and is then transmitted to the spark plug 4. In a proper explosion trend, the spark plug burns out with a typical voltage trend, this burn voltage ($U_{ARC}$) in turn being transformed into the primary winding 2 of the ignition coil 1. This arc voltage transformed onto the primary side activates correspondingly the pnp transistor 8 with the resistor 9 as emitter follower, so that this converts the arc voltage into a collector current (IC) proportional to it.

$$Ic = \frac{U_{BRENN} - U_{BE}}{R9} \approx \frac{U_{BRENN}}{R9}$$

The collector current Ic is therefore approximately proportional to the quotient of the arc voltage ($U_{ARC}$) minus the base-emitter voltage ($U_{BE}$) of the transistor 8 and the resistance value of the resistor 9 designed as an emitter follower. However, since this resistor 9 has a constant value and ($U_{BE}$) is negligibly small, the collector current Ic is approximately proportional to the arc voltage $U_{ARC}$. This current Ic flows from the collector of the transistor 8 by way of the resistor 10 to the earth potential, and it is converted at the resistor 10 into a voltage signal which can be evaluated easily and which is tapped between the terminal 11 and earth potential. This voltage signal can then be fed by way of the terminal 11 to evaluation electronics which, for example by means of a comparison of the detected voltage signal with a stored signal trend, carries out a monitoring of the functioning of the ignition system and, if faults are detected, initiates corresponding protective measures. To prevent temperature influences from falsifying the measurement result, it is expedient if the resistors 9 and 10 have the same temperature coefficient.

Figure 2:
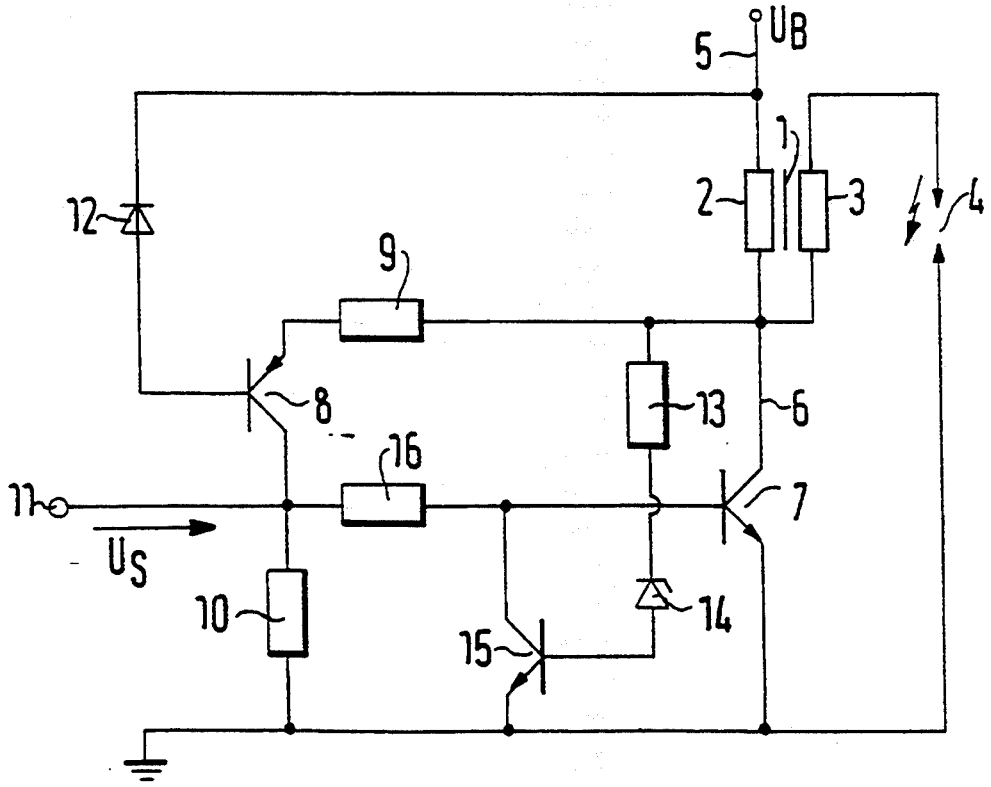

FIG. 2 shows the basic circuit described in a somewhat modified form, although the principle of detection of the voltage signal and the components used for this are the same. This becomes clear from the use of like reference symbols for like components. In addition, in this Figure, a diode 12 is inserted between the base of the transistor 8 and the battery voltage $U_B$ which ensures that the base-emitter stage of the ignition transistor 8 does not break down at a high positive battery voltage and with the transistor 7 cut through. In addition, there are also provided in this circuit a resistor 13 having a following Zener diode 14 between the feed line 6 and the base of a transistor 15 as well as a further resistor 16. The pnp transistor 15 is in this case connected on the emitter side to earth potential and on the collector side to the base of the ignition transistor 7. The further resistor 16 is located between the terminal 11 and the base of the ignition transistor 7. These components ensure that, at a high collector tension on the ignition transistor 7, this transistor does not break down prematurely. That is to say, by the use of the Zener diode 14, voltages above a specific potential are transmitted along the junction line 6 by way of the resistor 13 and the Zener diode 14 to the base of the transistor 15 and thus make this transistor 15 conductive, so that the base of the transistor 7 is brought to earth potential. This FIG. 2 is so arranged that the control-signal connection of the ignition transistor 7 can be used for emitting the voltage signal which represents the arc voltage. For this purpose, however, the resistor 10 must be rated accordingly, in order to prevent the transistor 7 from breaking down prematurely. That is to say, it is necessary to ensure that, during the burn time of an ignition spark, the voltage drop across the resistor 10 is lower than the voltage which is required for activating the transistor 7. This ensures that, without an additional signal line for monitoring the arc voltage at the terminal 11, with a time offset the ignition transistor 7 can be made conductive by means of a voltage signal ($U_S$) triggered by the control circuit (not shown), on the one hand, and the spark arc voltage can be transmitted to the evaluation circuit to be connected to the terminal 11, on the other hand.

These circuits described for detecting the arc voltage signal transformed onto the primary side can also be integrated monolithically, with the result that they require a smaller amount of space.

We claim:

1. A circuit arrangement for ignition systems for detecting an arc voltage at a spark plug, the arrangement comprising an ignition coil having a primary side on which the arc voltage is transformed and also having a primary winding; an ignition switch located in series with said primary winding of said ignition coil; a pnp transistor operating as a voltage converter and having a control stage so that the arc voltage transformed on said primary side activates said control stage, said transistor being connected on an emitter side to a connection between said primary winding and said ignition switch, said pnp transistor being connected on a base side to a battery voltage; a resistor operating as an emitter follower to said pnp transistor; a measuring element which is designed as a resistor, said transistor with its collector connection feeding to said measuring element a collector current which is proportional to the arc voltage.

2. A circuit arrangement as defined in claim 1; and further comprising a second resistor, said resistors having the same temperature coefficient.

3. A circuit arrangement as defined in claim 1; and further comprising a further resistor, said transistor having a collector; said ignition switch having a control electrode which is connected by said further resistor to said collector of said transistor so that a control signal for said ignition switch can be fed and a voltage proportional to the arc voltage can be extracted.

4. A circuit arrangement as defined in claim 3; and further comprising a signal line arranged so that the control signal can be fed through it for the ignition switch and the voltage signal proportional to the arc voltage can be extracted.

* * * * *